US006360495B1

(12) United States Patent
Schelfhout

(10) Patent No.: US 6,360,495 B1
(45) Date of Patent: Mar. 26, 2002

(54) SAND SPIKE SYSTEM

(75) Inventor: Stephen J. Schelfhout, Lynn Haven, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/436,825

(22) Filed: Nov. 9, 1999

Related U.S. Application Data

(63) Continuation-in-part of application No. 09/313,867, filed on May 17, 1999, now Pat. No. 6,093,069.

(51) Int. Cl.[7] ..... E02D 5/74; B63B 21/24

(52) U.S. Cl. ..... 52/155; 52/158; 52/162; 114/295; 441/11

(58) Field of Search ..... 52/155, 158, 162–164; 114/295; 441/11, 24

(56) References Cited

U.S. PATENT DOCUMENTS 3,012,644 A * 12/1961 Bush ..... 52/155
3,036,542 A * 5/1962 Robinson ..... 114/295
3,399,646 A * 9/1968 Vincent ..... 114/295
3,431,880 A * 3/1969 Pannell ..... 114/295
3,520,268 A * 7/1970 Bower ..... 114/295
3,525,187 A * 8/1970 Vincent ..... 114/295
3,577,949 A * 5/1971 Critcher ..... 114/295
3,732,841 A * 5/1973 Mayo ..... 114/295 X
3,839,984 A * 10/1974 Hinves ..... 114/295
4,076,313 A * 2/1978 Sperandeo, III ..... 114/295 X
4,347,802 A * 9/1982 Hossfeld ..... 114/295
4,404,666 A * 9/1983 Stevens ..... 114/295
4,682,559 A * 7/1987 Schnitzer et al. ..... 114/295

* cited by examiner

*Primary Examiner*—Winnie G. Yip
(74) *Attorney, Agent, or Firm*—Harvey A. Gilbert; Donald G. Peck

(57) ABSTRACT

A sand spike system anchors a cable in an earthen substrate. A penetrator connected to the cable has folded petal-shaped sections of spring steel propelled into the earth by a propellant. Cables connected to opposite petal-shaped sections help arrest penetration and spread the folded petal-shaped sections outwardly to increase the resistance to tensile loads. Sand spike system may use a delay activated or an electrically initiated propellant to drive the penetrator into the earth instead of mechanical, hydraulic, or pneumatic force. This permits remote initiation of sand spikes from a safe distance on land or underwater. In addition, each sand spike creates far a greater surface area to entrain and use the earthen substrate and not friction to anchor, and, as a consequence, it safely bears greater tensile loads on the cable.

16 Claims, 3 Drawing Sheets

SAND SPIKE SYSTEM

CROSS REFERENCE TO RELATED APPLICATIONS

This is a continuation in part of copending U.S. Pat. application entitled "Low Watch Circle Buoy System" by Steve Schelfout, U.S. Patent and Trademark Office Ser. No. 09/313,867 (NC 79,720), filed May 17, 1999, now U.S. Pat. No. 6,093,069, and incorporates all references and information thereof by reference herein.

Applicant hereby claims the benefit of the filing date May 17, 1999 of prior application Ser. No. 09/313,867.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Some of the methods currently used to anchor an object to the earth rely on driving a small rod into the substrate. External manual forces or explosives have been used to drive rod-like structural elements sufficiently to embed them. In either case, frictional forces acting along the length of the rods have been the main forces that retain them in the earthen substrate.

Another soil anchor, called the Manta Soil Anchor by Form Engineering of Dougiasville (Atlanta), Ga. 30135 has a plate mechanically, hydraulically, or pneumatically driven into the earthen substrate via a first rod. The first rod is withdrawn, and another rod or line attached to a pinned joint on the plate rotates the plate about the pinned joint so that the plate lies perpendicular where the first rod was. Apparently, considerable mechanical, hydraulic, or pneumatic force must be expended by a driving mechanism connected to the first rod to drive the plate into the earth in one direction, and considerable force must be exerted in the opposite direction by the mechanism or another machine to rotate the plate. These oppositely directed forces are likely to be of such magnitude that they may cause failure along the linkage and joint structure at the plate. In addition, the relatively cumbersome paraphernalia associated with this device is likely to interfere with remote or delayed insertion in unobtrusive or covert applications. Also, the anchoring forces that are characteristic of this type of anchor system are low in magnitude.

Thus, in accordance with this inventive concept, a need has been recognized in the state of the art for an anchor explosively propelling a penetrator having folded petal-shaped sections into the earth and extending the sections into a fan-shaped structure to secure a remotely extending cable.

SUMMARY OF THE INVENTION

The present invention provides a system for anchoring a cable. A penetrator has a plurality of petal-shaped sections extending outwardly from a central section. A propellant in a tubular shell is ignited by a squib and an initiator to propel the penetrator into the earth. A spring actuated spool is coupled to the cable and has cables that are each connected to a different one of the petal-shaped sections to arrest penetration and to spread the petal-shaped sections to extend outwardly.

An object of the invention is to provide an anchor explosively propelled into the earth to secure a remotely extending cable.

Another object of the invention is to provide an anchor using an electrically initiated propellant to drive itself into the earth instead of mechanical force.

Another object of the invention is to provide an anchor having a penetrator that laterally extends after it has been explosively propelled into the earth to increase holding capabilities.

Another object of the invention is to provide an anchor remotely initiated from a safe distance on land and underwater to, through, and beyond the surfzone.

Another object of the invention is to provide an anchor using far greater surface area in the earthen substrate to anchor itself to safely withstand greater tensile forces.

Another object of the invention provides a self-contained anchor having only lead wire(s) extending from it to electrically activate an initiator and/or squib.

These and other objects of the invention will become more readily apparent from the ensuing specification when taken in conjunction with the appended claims.

DESCRIPTION OF THE PREFERRED EMBODIMENT

Figure 1:
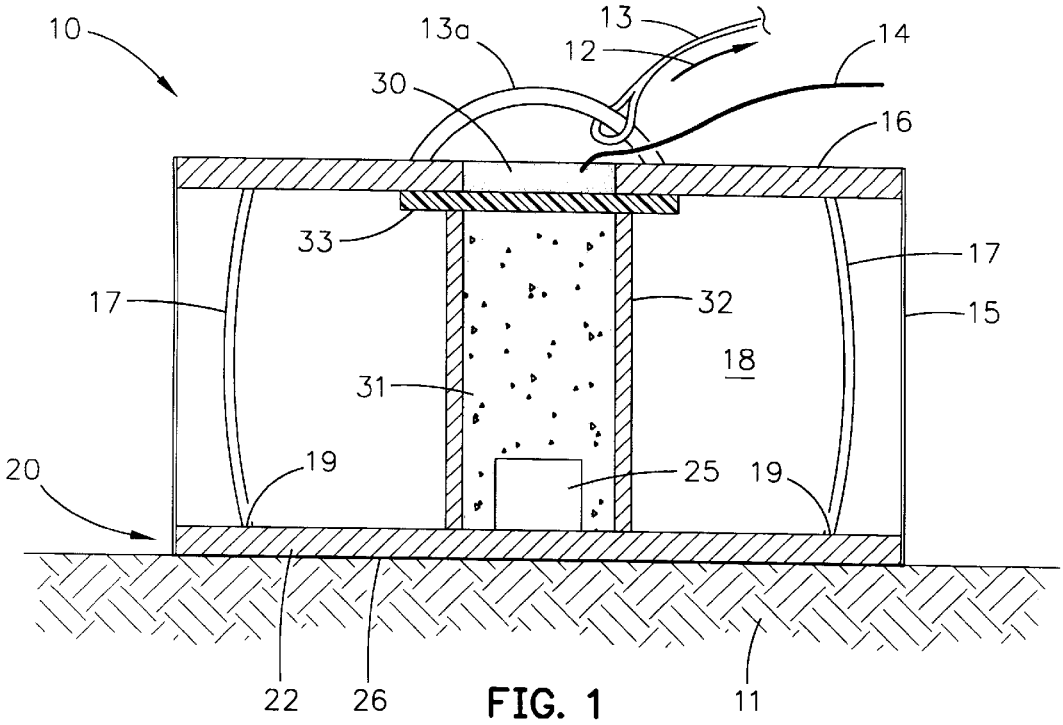
FIG. 1 is a cross-sectional view of the invention on the earth prior to initiation.

Referring to FIG. 1, sand spike system, or sand spike 10 is shown resting on earthen substrate 11 prior to activation. When activated, as described below, sand spike system 10 provides an anchor embedded in earthen substrate 11 to withstand tensile loads 12 on cable, or line 13 attached via mounting ring 13*a* secured to spool 16. Earthen substrate, or earth 11 is understood to be any of a variety of soil compositions that are common on land, or marine sediments that settle to and collect at the bottoms of bodies of water.

Sand spike system 10 is packaged to be complete and self-contained, and, as such, it may be prelocated to rest on earthen substrate 11 for prolonged periods of time before it is safely activated over a remotely extending lead 14. Optionally, one or more sand spikes 10 could be directly mounted on the bottoms of containers of equipment or instrumentation, and cable 13 for each sand spike 10 might not be needed. When the containers or sand spikes 10 alone are placed to rest on land and underwater to, through, and beyond the surfzone, then each sand spike 10 may be activated over lead 14 from a safe distance to anchor the containers or individual spikes.

Sand spike 10 has a metal or plastic square-shaped outer shell 15 that fits around and is connected to spring-actuated spool 16 at one end. Outer shell 15 could have other cross-sectional shapes, e.g., rectangular, circular, etc. instead of a square shape so long as it is large enough to define an interior 18 and protects the components contained within it from the ambient and rigors of routine operations.

Figure 2:
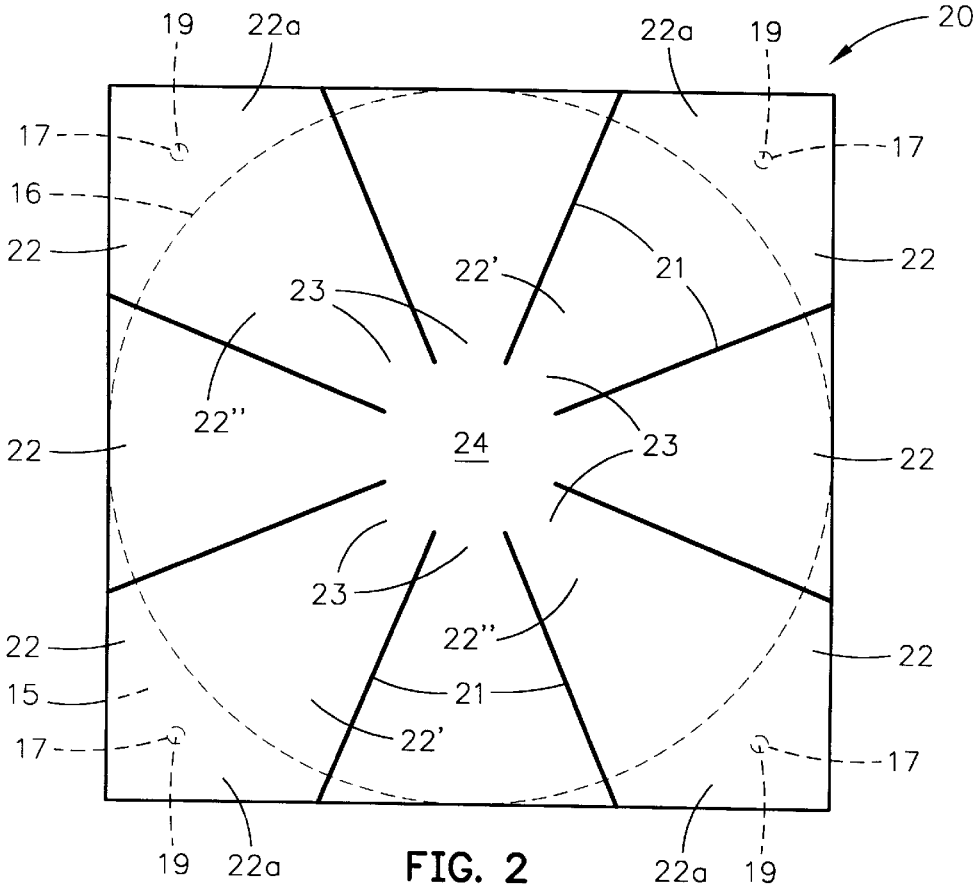
FIG. 2 is a front view of a penetrator having a center portion and petal-shaped sections laterally extended in a square-shaped, platelike structure.

Referring also to FIG. 2, spring-actuated spool 16 has four lines, or cables 17 connected to it. Cables 17 are spaced to extend in quadrature from spool 16 across interior 18 of shell 15, and distal ends 19 of cables 17 are connected to penetrator 20. Metal or other strong, heat resistant materials may be preferred for cables 17 to withstand the effects of heat and blast as penetrator 20 is embedded in the earth. Spool 16 steadily, or progressively increases the tension on each of cables 17 as more of each of cables 17 are pulled from it. Many different designs for spring actuated spool 16 could be made by one of ordinary skill in the art. Spring actuated spool 16 could be fabricated to have a mechanism similar to a conventional spring-biased window shade common in many homes. By way of further example, spring actuated spool 16 could be supported via a journal (not shown) in outer shell 15 and have one or more elastomers (not shown) held in tension between spool 16 and shell 15. When tensions on cables 17 cause them to be unwound, or pulled, from spool 16, this action would cause more winding or tightening of the elastomers, and consequently, the tensions exerted by the elastomers on cables 17 would progressively increase. When the combined tensions on cables 17 equal the tensions exerted by the elastomers of spool 16, no more of cables 17 are payed out.

Penetrator 20 has slots, or separations 21 that separate and define a plurality of petal-shaped sections 22 extending radially outwardly across junctures 23, (or elongate juncture regions 23) from central section 24. During embedding of penetrator 20 in the earth, the material of junctures 23 (between petal-shaped sections 22 and central section 24) flexes to a greater extent than other parts of penetrator 20. Petal-shaped sections 22, junctures 23, and central section 24 are virtually coplanar and cover the other end of outer shell 15.

Figure 3:
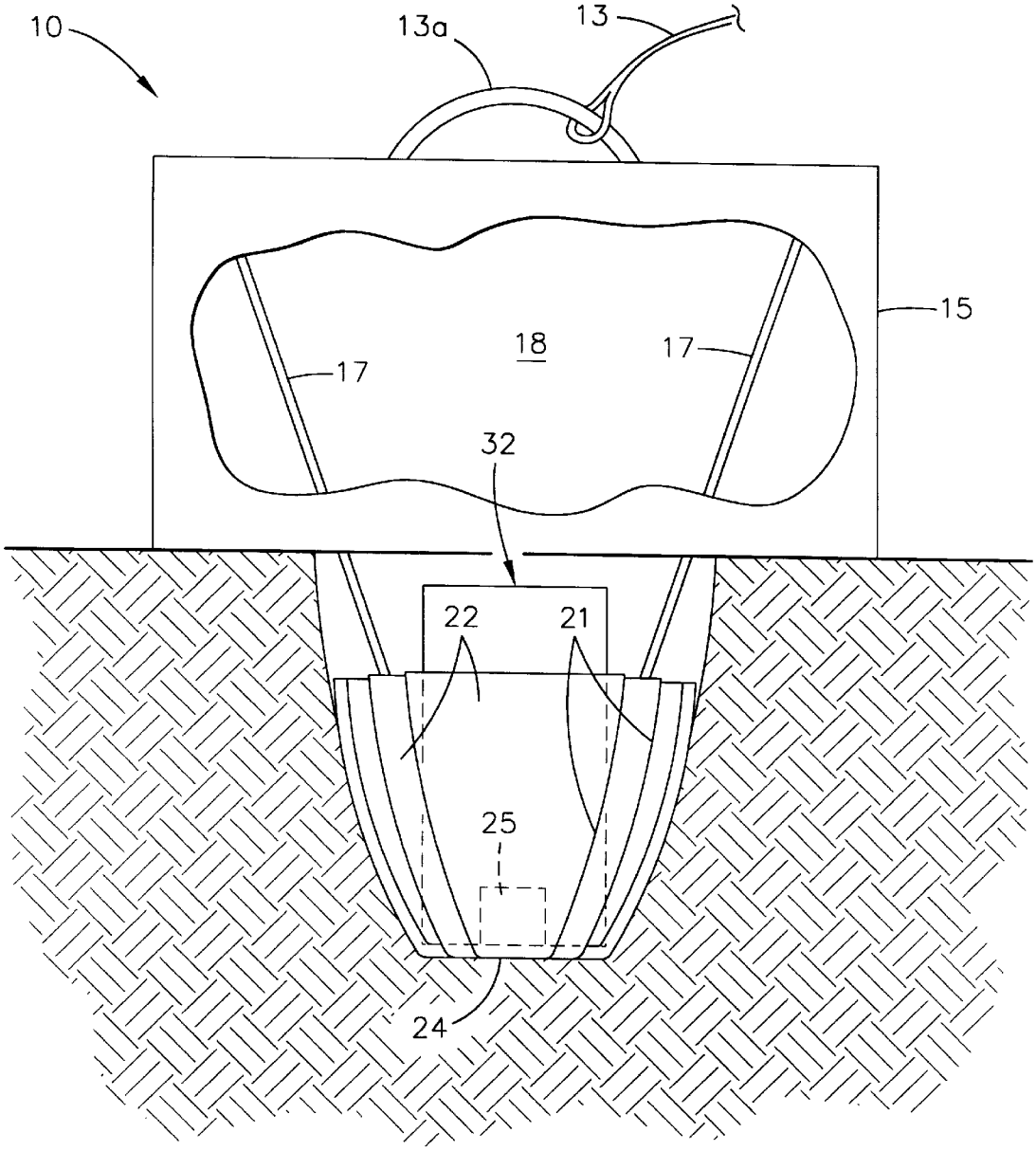
FIG. 3 shows sand spike of this invention as burning propellant propels folded penetrator into earthen substrate.
Figure 4:
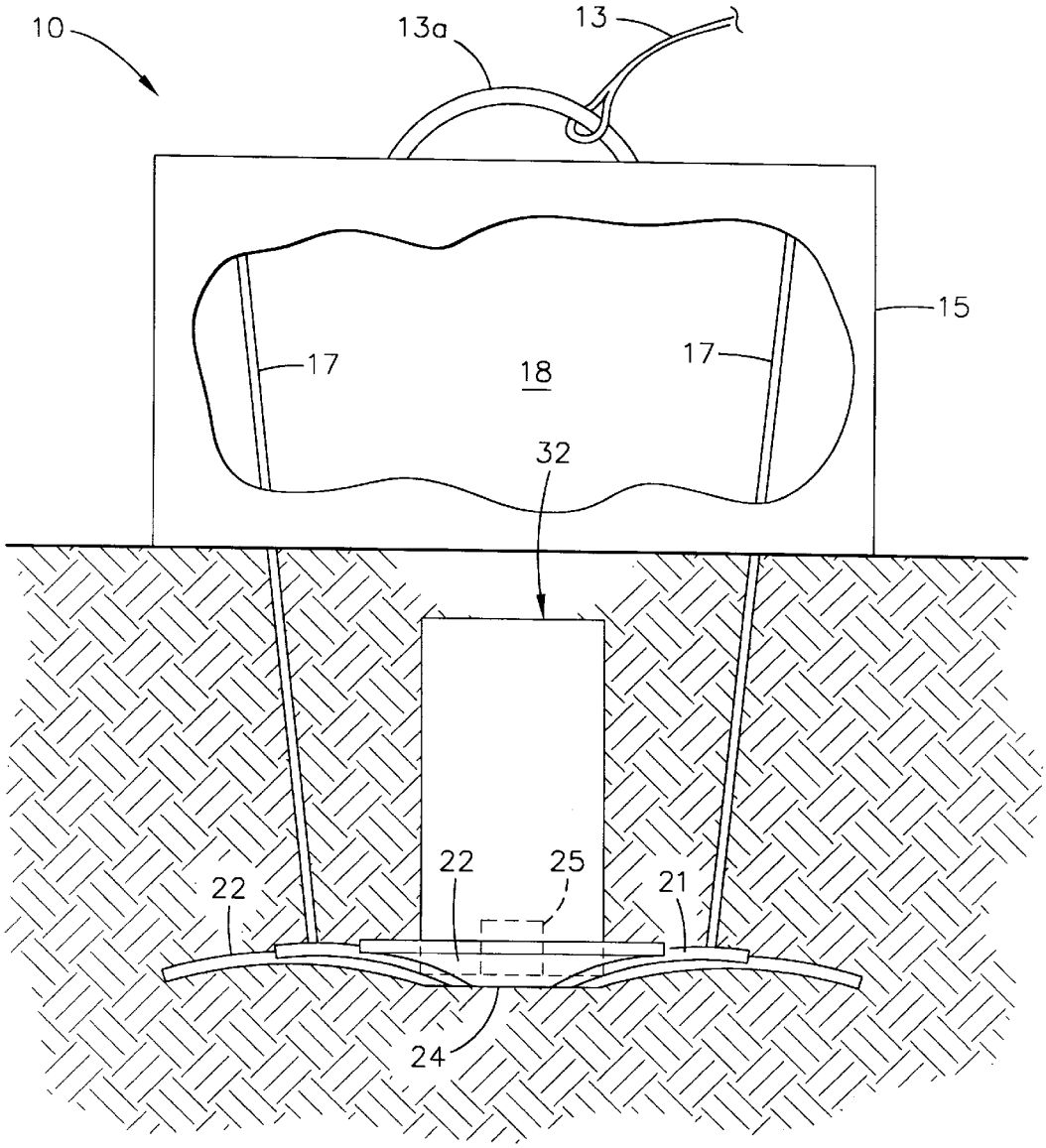
FIG. 4 shows sand spike of this invention after petal-shaped sections of the penetrator extend radially outwardly from a central portion and become embedded in the earthen substrate.

Penetrator 20 may be fabricated from a sheet of flexible spring steel, or similar material that has memory, or hysteresis to flex back to its original shape. The spring steel construction will bend along junctures 23 as petal-shaped sections 22 are folded while central section 24 and petal-shaped sections 22 penetrate the earth during deployment, see FIG. 3. When penetration stops, the flexible spring steel will urge that petal-shaped sections 22 bend again along junctures 23 to flex them back toward their original coplanar form, see FIG. 4. Rugged plastic and/or composite materials might also be used as petal-shaped sections 22 and central section 24 of penetrator 20, and penetrator 20 might have rounded, rectangular, or other shapes instead of square as shown.

Penetrator 20 has metal slug 25 secured to central section 24 and is disposed in interior 18 of sand spike 10. Slug 25 is made from a dense material, such as lead, that increases the mass of penetrator 20 to aid and assure deep penetration in earthen substrate 11. Penetrator 20 also has thin, flexible outer cover 26 that reaches across slots 21, petal-shaped sections 22, junctures 23, and central section 24 to seal interior 18 of sand spike 10 from the ambient. Typically, a suitable material for cover 26 (that may be transparent) could be the material commercially marketed under the trademark MYLAR.

Distal ends 19 of cables 17 are connected to end portions 22a of opposite ones of diagonal pairs of petal-shaped sections 22' and 22" of petal-shaped sections 22 of penetrator 20. In the alternative, these connections to distal ends 19 of cables 17 could have been made to end portions of horizontally aligned pair and vertically aligned pair of petal-shaped sections 22.

Sand spike 10 has a lead 14 connected to a squib and initiator 30 that is located at the center of spring actuated spool 16. Initiator 30 may be electronic or electromechanical components to activate propellant material 31 inside of tubularly-shaped plastic, or metal shell 32 that is secured to central section 24 and/or slug 25 of penetrator 20. Initiator circuit 30 may be an appropriate switching circuit responsive to coded or uncoded activation signals over lead 14 to activate a squib that ignites propellant material 31.

In the alternative, lead 14 could be eliminated, and an acoustic signal or electromagnetic signal might be used to activate sand spike 10. In this case, initiator 30 might include a suitable receiver circuit to receive and decode an initiation, or activation signal. In addition, any of a wide variety of delay timers and/or delay detonators might be used in association with initiator circuit 30 to activate propellant 31 after a predetermined delay.

Propellant 31 may be a rocket propellant that burns at a controlled rate to create sufficient propulsive force for a long enough period to embed penetrator 20 into earthen substrate 11. Many different suitable propellants for military and commercial uses are available so that the rate of burning, amount of propulsive force, burn period and amount of penetration are selectable according to the task at hand. A layer of insulator material 33 mounted on spring-actuated spool 16 provides a refractive surface for burning propellant 31 in shell 32 to prevent destruction and/or jamming of spool 16 during ignition and burn.

Optionally, an explosive composition might be selected for propellant 31 to explode and drive penetrator 20 into the earth. In this case, initiator 30 could include suitably interconnected integrated battery, receiver/logic board, capacitor-discharge firing circuit, and explosive squib. Either way, signals over lead 14 may be used to activate propellant 31 and embed penetrator 30 in earthen substrate 11.

Sand spike 10 is a compact, reliable system for embedding an anchor for cable 13. In one exemplary embodiment penetrator 20 measured two inches square, and the depth from the outside of spring actuated spool 16 to outer cover 26 measured one inch. This configuration embedded penetrator 20 about one to two feet into earthen substrate 11.

In operation, one or more sand spikes 10 are placed on earthen substrate 11. A detonation signal is fed over lead 14 of each sand spike 10 to initiator 30 to initiate propellent 31. The burning of propellant 31 generates pressure in tubular shell 32 to propel tubular shell 32, metal slug 25, and penetrator 20 from spring actuated spool 16 into earthen substrate 11. Thus, tubular shell 32 and penetrator 20 (including metal slug 25) penetrate up to two feet into earthen substrate 11.

During the initial part of penetration in earthen substrate 11, the earth forces at least portions of petal-shaped sections 22 to be folded back from central section 24 toward metal slug 25. During further penetration in earthen substrate 11, resistive frictional forces of penetration in the earth act on central section 24 and at least portions of the folded-back exposed surfaces of petal-shaped sections 22 so that portions of petal-shaped sections 22 may lie substantially along, or adjacent the outer surface of tubular shell 32, see FIG. 3. Simultaneously, cables 17 unwind from spring actuated spool 16, and tensions on cables 17 are steadily increased to predetermined levels by the tightening elastomers of spring actuated spool 16. These increased tensions and the frictional forces arrest penetration by penetrator 20, and it comes to a stop in earthen substrate 11.

After penetration stops, the predetermined tensions on cables 17 further act on end portions 22*a* of petal-shaped sections 22' and 22" via distal ends 19 of cables 17. These predetermined tensions urge, or pull the outermost edges of petal-shaped sections 22' and 22" of penetrator 20 back and away from metal slug 25 and spread petal-shaped sections 22'and 22" outwardly from central portion 24 to embed themselves in the earth. As petal-shaped sections 22' and 22" become embedded, the other petal-shaped sections 22 also become embedded and also extend radially outwardly from central portion 24, see FIG. 4. As tensile loads 12 are exerted over cable 13, this force will also cause all petal-shaped sections 22 to become even more completely embedded radially outwardly from central portion 24 in a coplanar orientation in earthen substrate 11. This will entrain more earth and increase the resistance to withdrawing penetrator 30 from earthen substrate 11, and cable 13 will be able to withstand greater tensile loads 12.

Sand spike 10 is a self-contained, standalone device that provides an anchor in wet or dry earthen substrate 11. Sand spike 10 is electrically activated at a safe distance to propel penetrator 20 into the earth. Unlike conventional soil anchors, sand spike 10 does not hold tensile loads by only frictional engagement where its sides contact the earth. Instead, petal-shaped sections 22 extend radially outwardly after penetration into earthen substrate 11 to entrain, or cup a portion of the earth and thereby hold increased tensile loads 12. Thus, sand spike 10 is capable of withstanding greater tensile forces, or proof loads than prior art soil anchors.

Sand spike 10 may use an electrically initiated propellant 31 to drive itself into the earth instead of mechanical force. As a consequence, each sand spike 10 can be remotely initiated from a distance which will increase the operational safety for the operator in all kinds of environments including on land and underwater to, through, and beyond the surf-zone.

Sand spike 10 uses far greater surface area in the earthen substrate 11 to entrain the earth and anchor itself. Consequently, it is able to withstand greater forces and keep itself safely anchored in earthen substrate 11. Sand spike 10 is totally self-contained with only load supporting cable 13 and lead wire(s) 14 leading from it to electrically activate initiator 30 and its squib.

Having the teachings of this invention in mind, modifications and alternate embodiments of this invention may be fabricated to have a wide variety of applications in many other environments, e.g., other shapes could be made having larger or smaller dimensions to control the amount of penetration and holding force. Different fabrication materials for the components of sand spike 10 and/or different schemes for delayed and/or remote initiation of sand spike 10 could be selected to accommodate a variety of applications without departing from the scope of this invention.

The disclosed components and their arrangements as disclosed herein all contribute to the novel features of this invention. This invention provides a reliable and cost-effective means to quickly and safely anchor a remotely extending cable in the earth. Therefore, sand spike system 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

I claim:

1. A system for anchoring a cable comprising:

a penetrator having a metal slug mounted on a central section, a plurality of petal-shaped sections extending outwardly from said central section and a plurality of cables connected to said petal-shaped sections;

an inner tubular shell mounted on said central section, said tubular shell having a propellent therein;

an initiator adjacent said propellant to ignite said propellant to propel said penetrator into the earth; and a spool adjacent said inner tubular shell, said spool being coupled to a single cable and to said plurality of cables.

2. A system according to claim 1 further comprising:

insulator material between said spool and said propellant; and an outer shell extending between said spool and said penetrator to define an interior.

3. A system according to claim 2 in which said penetrator is comprised of spring steel, said cables are comprised of four cables, said metal slug aids penetration of said penetrator in said earth, and said insulator material provides a refractive launching surface for burning said propellant.

4. A system according to claim 3 in which said petal-shaped sections and said central section are virtually coplanar, and said petal-shaped sections are folded back to lie adjacent the outer surface of said inner tubular shell during said penetration.

5. A system according to claim 4 in which frictional forces act on said central section and said folded-back petal-shaped sections during said penetration to help arrest said penetration in said earth.

6. A system according to claim 5 in which said cables are each connected to opposite ones of said petal-shaped sections to help arrest said penetration and spread said folded-back petal-shaped sections outwardly to increase the resistance to tensile loads.

7. A system according to claim 6 in which said initiator is responsive to activate said propellant.

8. A system according to claim 6 in which said initiator receives signals to activate said propellant.

9. A system according to claim 6 in which said initiator activates said propellant after a predetermined delay.

10. A method of anchoring a cable comprising the steps of:

providing a penetrator having a plurality of coplanar petal-shaped sections extending outwardly from a central section;

providing propellant in an inner tubular shell mounted on said central section;

initiating said propellant to propel said penetrator into the earth;

embedding said penetrator in said earth; and retaining said embedded penetrator by said petal-shaped sections.

11. A method according to claim 10 further comprising the step of:

radially outwardly extending said petal-shaped sections to provide said step of retaining.

12. A method according to claim 11 further comprising the step of:

connecting cables to said petal-shaped sections.

13. A method according to claim 12 further comprising the steps of:

arresting penetration into said earth; and spreading petal-shaped sections in said earth.

14. A system for anchoring a cable comprising:

means for penetrating the earth having a plurality of petal-shaped sections extending outwardly from a central section;

means for propelling said penetrating means into said earth being mounted on said central section;

means for initiating the igniting of said propelling means to propel said penetrating means into said earth; and means for tensioning cables coupled to different ones of said petal-shaped sections.

15. A system according to claim 14 further comprising:

means for increasing the mass of said penetrating means.

16. A system according to claim 15 further comprising:

means for insulating said cable tensioning means from said ignited propelling means; and means extending between said cable tensioning means and said penetrating means for defining an interior.

* * * * *